US010238195B2

(12) United States Patent
Clarke et al.

(10) Patent No.: US 10,238,195 B2
(45) Date of Patent: Mar. 26, 2019

(54) LUGGAGE APPARATUS

(71) Applicants: Tamar Clarke, Ascot (GB); Tom Clarke, Ascot (GB)

(72) Inventors: Tamar Clarke, Ascot (GB); Tom Clarke, Ascot (GB)

( * ) Notice: Subject to any disclaimer, the term of this patent is extended or adjusted under 35 U.S.C. 154(b) by 0 days.

(21) Appl. No.: 15/128,391

(22) PCT Filed: Mar. 23, 2015

(86) PCT No.: PCT/GB2015/050847
§ 371 (c)(1),
(2) Date: Apr. 24, 2017

(87) PCT Pub. No.: WO2015/145118
PCT Pub. Date: Oct. 1, 2015

(65) Prior Publication Data

US 2017/0119117 A1 May 4, 2017

(30) Foreign Application Priority Data

Mar. 22, 2014 (GB) ..... 1405151

(51) Int. Cl.

| | |
|---|---|
| ***A45C 9/00*** | (2006.01) |
| ***A45C 5/14*** | (2006.01) |
| ***A45C 13/26*** | (2006.01) |
| ***A45C 13/04*** | (2006.01) |

(52) U.S. Cl.
CPC ..... *A45C 9/00* (2013.01); *A45C 5/14* (2013.01); *A45C 13/04* (2013.01); *A45C 13/262* (2013.01); *A45C 2009/002* (2013.01); *A45C 2009/007* (2013.01); *A45C 2013/267* (2013.01)

(58) Field of Classification Search
CPC .. A45C 9/00; A45C 5/14; A45C 13/04; A45C 13/262; A45C 2009/002; A45C 2009/007; A45C 2013/267
See application file for complete search history.

(56) References Cited

U.S. PATENT DOCUMENTS 5,447,217 A * 9/1995 Chou ..... A45C 13/262 16/113.1
5,519,919 A * 5/1996 Lee ..... B62B 1/147 16/113.1

(Continued)

FOREIGN PATENT DOCUMENTS

CN 202874103 U 4/2013
EP 1867547 A2 12/2007

OTHER PUBLICATIONS

International Search Report and Written Opinion, issued by the European Patent Office for PCT/GB2015/050847, dated Jun. 30, 2015. 15 pages.

*Primary Examiner* — Tri Mai
(74) *Attorney, Agent, or Firm* — Colby Nipper PLLC

(57) ABSTRACT

A luggage apparatus is described. The luggage apparatus comprises a body portion and a stabilizing mechanism, the stabilizing mechanism being movable with respect to the body portion from a stowed position to a deployed position. With the stabilizing mechanism in the deployed position, the body portion can be tilted from an upright position to an inclined position, in the inclined position the stabilizing mechanism at least partially supporting the body portion.

10 Claims, 3 Drawing Sheets

(56) References Cited

U.S. PATENT DOCUMENTS

| | | | | | |
|---|---|---|---|---|---|
| 5,630,488 | A * | 5/1997 | Chen | A45C 13/262 | 16/113.1 |
| 5,639,109 | A * | 6/1997 | Liang | A45C 13/262 | 16/113.1 |
| 5,816,374 | A * | 10/1998 | Hsien | A45C 5/14 | 16/405 |
| 5,873,439 | A * | 2/1999 | Liang | A45C 5/14 | 16/34 |
| 5,984,326 | A * | 11/1999 | Abraham | A45C 5/14 | 190/18 A |
| 6,279,705 | B1 * | 8/2001 | Wu | A45C 5/14 | 190/115 |
| 6,345,414 | B1 * | 2/2002 | Chen | A45C 5/14 | 16/113.1 |
| 6,497,311 | B2 * | 12/2002 | Tiramani | A45C 3/001 | 16/113.1 |
| 7,793,970 | B2 | 9/2010 | Fegler et al. | | |
| 8,020,678 | B2 * | 9/2011 | Tsai | A45C 5/146 | 190/115 |
| 2008/0017463 | A1 * | 1/2008 | Huang | A45C 5/14 | 190/18 A |
| 2008/0135366 | A1 * | 6/2008 | Katz | A45C 5/14 | 190/18 A |
| 2008/0223679 | A1 * | 9/2008 | Wong | A45C 13/385 | 190/18 A |
| 2010/0078279 | A1 * | 4/2010 | Bowers | A45C 5/14 | 190/18 A |
| 2012/0161408 | A1 | 6/2012 | Sidhu | | |

* cited by examiner

LUGGAGE APPARATUS

FIELD OF THE INVENTION

The present invention relates to an improved luggage apparatus. Particularly, but not exclusively, the present invention relates to an improved luggage apparatus incorporating a seat for an infant or child.

BACKGROUND TO THE INVENTION

Luggage such as suitcases with wheels are very popular. The wheels assist the user in moving the luggage around. Suitcases are generally rectangular and, when being packed or unpacked, are designed to lie on one of the suitcase surfaces with the largest surface area, with the opposite, opening surface being hinged to one of the longer sides. To manoeuvre such a suitcase, wheels are provided on one of the shorter sides with a telescopic handle protruding from the opposite short side for the user to pull the suitcase along.

This arrangement has a number of disadvantages. First, the user has to take care when packing a suitcase as when the suitcase is freestanding on the wheeled end, the centre of gravity is quite high and the suitcase can topple over if all the weight is packed at the top. This problem is exacerbated if a user carries an additional weight on top of the suitcase such as a briefcase. Travel briefcases are often provided with straps to feed the telescopic handle of the luggage through and this additional weight raises the centre of gravity even higher.

Further, it is difficult to push wheeled suitcases, as may be the case if the user wishes to push a child sitting on suitcase. This difficulty is caused by the height of the handle; when pulling a suitcase the pulling hand is at waist level and the arm is substantially straight. When pushing a pram, for example, both hands are used and the arms are bent at the elbow, the hands being higher than in the pulling situation by the length of the user's forearms.

SUMMARY OF THE INVENTION

According to a first aspect of the present invention there is provided a luggage apparatus, the luggage apparatus comprising:

a body portion; and a stabilising mechanism, the stabilising mechanism being movable with respect to the body portion from a stowed position to a deployed position;

wherein with the stabilising mechanism in the deployed position, the body portion can be tilted from an upright position to an inclined position, in the inclined position the stabilising mechanism at least partially supporting the body portion.

In at least one embodiment, the provision of a stabilising mechanism allows the body portion to be tilted from an upright position to an inclined position such that the stabilising mechanism takes part of the weight of the body portion preventing it from toppling over.

The body portion may define a body portion exterior.

In the body portion upright position, the centre of gravity of the luggage apparatus may be inside the body portion exterior.

In the body portion inclined position, the centre of gravity of luggage apparatus may be out with the body portion exterior.

In the body portion inclined position, the centre of gravity of the luggage apparatus may be lower than in the body portion upright position.

The body portion may define at least one storage compartment for storing luggage.

The body portion may comprise a frame.

The frame may be moulded.

The frame may be moulded from a polymeric material.

The frame may be injection moulded.

The polymeric material may comprise expanded polypropylene.

The frame may define one or more storage compartments.

The body portion may comprise one or more frame coverings.

In some embodiments the frame coverings may define a body portion external surface.

At least some of the frame coverings may be removable or at least partially removable from the frame.

At least some of the frame coverings may be movable with respect to the frame.

The luggage apparatus may be configurable between a compact configuration and a stabilised configuration.

Moving the luggage apparatus to the stabilised configuration may move the stabilising mechanism to the deployed position.

The luggage apparatus may be further configurable to an interim configuration between the compact configuration and the stabilised configuration.

In the compact configuration, the stabilising mechanism may be stowed.

In the interim configuration, stabilising mechanism may be stowed.

The body portion may define a stabilising mechanism storage portion.

The stabilising mechanism storage portion may be a recess defined by the body portion.

The stabilising mechanism may be movably attached to the body portion.

The stabilising mechanism may be pivotally attached to the body portion such that in moving from the stowed position to the deployed position the stabilising mechanism pivots with respect to the body portion.

The luggage apparatus may further comprise a handle.

The handle may comprise a gripping portion and a connecting portion.

The connecting portion may connect the gripping portion to the luggage apparatus body portion.

The handle may be movable with respect to the body portion between a stowed position and a deployed position.

In the luggage apparatus compact configuration, the handle may be in the stowed position.

In the luggage apparatus stabilised configuration, the handle may be in a deployed position.

Where there is a luggage apparatus interim configuration, the handle may be in the handle deployed position or may be in an interim position between the handle stowed position and the handle deployed position.

The body portion may define a handle storage portion.

The handle storage portion may be a recess defined by the body portion.

The handle may be releaseably attached to the body portion.

In a preferred embodiment the handle is telescopically attached to the body portion.

The handle connecting portion may be telescopic.

The handle connecting portion may comprise a plurality of telescopic sections.

In the luggage apparatus interim configuration, the luggage apparatus may be adapted to be pulled by a user.

The luggage apparatus may comprise at least one movement means adapted to permit the luggage apparatus to be manoeuvred by pushing or pulling.

The at least one movement means may be at least one wheel.

The at least one movement means may be associated with a body portion base. The body portion base may be the body portion surface having the smallest surface area.

The body portion base may be the body portion surface closest to the ground when the body portion is in the upright position.

In the preferred embodiment, the at least one movement mechanism may be a pair of wheels, each wheel associated with a corner of the body portion base.

In the luggage apparatus stabilised contribution the luggage apparatus may be adapted to be pushed and/or pulled by the user.

In the luggage apparatus interim configuration, the handle gripping portion may be displaced from the body portion by a first distance and in the luggage apparatus stabilised configuration, the handle gripping portion may be displaced from the body portion by a second distance, the second distance being greater than the first distance. Such an arrangement facilitates pushing the luggage apparatus in the stabilised configuration and pulling the luggage apparatus in the interim configuration, the displacement of the handle gripping portion being chosen to suit each configuration.

The stabilising mechanism may further comprise at least one stabilising mechanism movement means.

The at least one movement means may be at least one wheel.

In the preferred embodiment the at least one stabilising mechanism movement means may be a pair of wheels. When the luggage apparatus has to wheels attached to the body portion, a single wheel on the stabilising mechanism provide stability for the luggage apparatus but, in certain embodiments, a further pair of wheels on the stabilising mechanism is preferred.

The luggage apparatus may define a load-bearing section.

The luggage apparatus load-bearing section may be defined at least partially by the body portion.

Where the body portion comprises a frame, the frame may define part of the load-bearing section.

The body portion load-bearing section may be an upper part of the body portion when the body portion is in the upright position.

The luggage apparatus load-bearing section may be at least partially defined by the handle.

In some embodiments the luggage apparatus load-bearing section may be at least partially defined by the handle connecting portion.

The body portion and the handle connecting portion (when the handle is in the interim or deployed position) may combine to define a load-bearing section which can receive a load such as a briefcase or a child.

The handle may be linked to the stabilising mechanism such that moving the handle to the deployed position moves the stabilising mechanism to the deployed position. Such an arrangement minimises the action required by the user convert the luggage apparatus to the stabilised configuration.

The luggage apparatus load-bearing section may define a seat for an infant or a child.

The seat may comprise a bottom support and a back support.

The bottom support may be substantially defined by the body portion load-bearing section and the back support may be substantially defined by the handle connecting portion load-bearing section.

At least a portion of the frame covering may be movable to reveal a bottom support defined by the body portion frame. In one embodiment, the bottom support is a seat.

The frame covering portion may be attachable to the handle connecting portion to define a back support surface. In one embodiment, the back support is a backrest.

In the compact configuration, the bottom support and the back support surface may be concealed within the body portion.

In the compact configuration the bottom support and the back support surface may be adjacent one another.

Moving the luggage apparatus to the stabilised configuration may increase the footprint of the luggage apparatus compared to the footprint of the luggage apparatus in the compact configuration (when the body portion is in the upright position).

In the luggage apparatus compact configuration, the luggage apparatus may be sized to fit in an aircraft overhead locker.

DETAILED DESCRIPTION OF THE DRAWINGS

Figure 2:
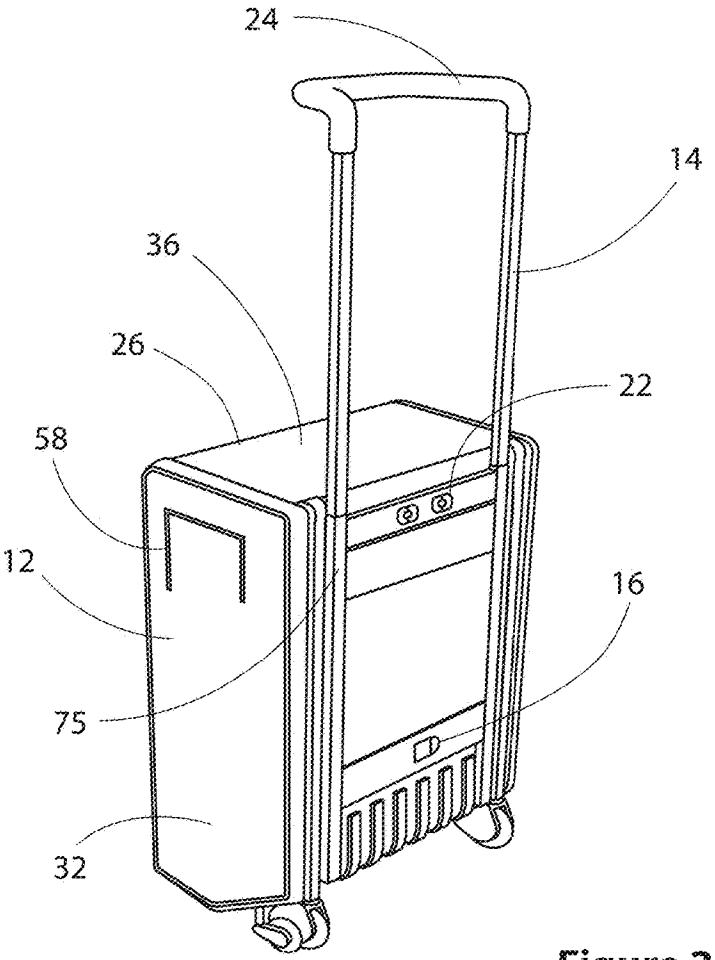
FIG. 2 shows a perspective view of the luggage apparatus of FIG. 1 in an interim configuration.
Figure 1:
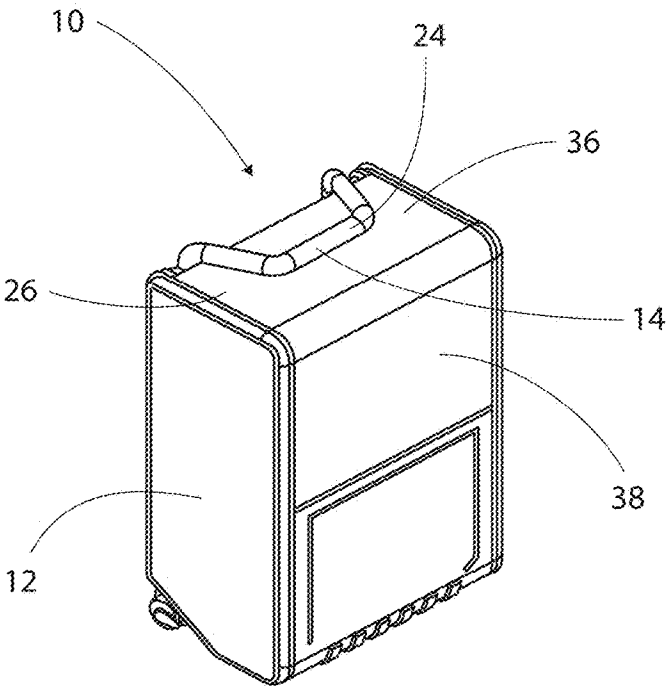
FIG. 1 shows a perspective view of a luggage apparatus in a compact configuration according to an embodiment of the present invention.

Referring to FIG. 1, a perspective view of a luggage apparatus, generally indicated by reference numeral 10 in a compact configuration, according to an embodiment of the present invention; FIG. 2, a perspective view of the luggage apparatus of FIG. 1 in an interim configuration, and FIG. 3, a perspective view of the luggage apparatus of FIG. 1 in a stabilised configuration, the luggage apparatus 10 comprises a body portion 12, a handle 14 and a stabilising mechanism 16. As can be best seen in FIG. 3, both the body portion 12 and the stabilising mechanism 16 have wheels 18,20 respectively, which permit the luggage apparatus 10 to be manoeuvred.

The luggage apparatus 10 is usable in three configurations. The first configuration, the compact configuration, is shown in FIG. 1. In this configuration, a handle gripping portion 24 is adjacent an upper surface 26 of the body portion 12.

The second configuration, the interim configuration, is shown in FIG. 2. In this configuration, the handle 14 is telescopically extended from a handle support 75 such that the apparatus 10 can be dragged behind a person, with the weight of the luggage apparatus being supported on the wheels 18,20. The handle 14 is secured in the compact configuration by a locking mechanism (not visible) and the luggage apparatus 10 is provided with a first button 22 to release the locking mechanism and allow the handle 14 to telescope to the interim position from the handle support 75.

Figure 3:
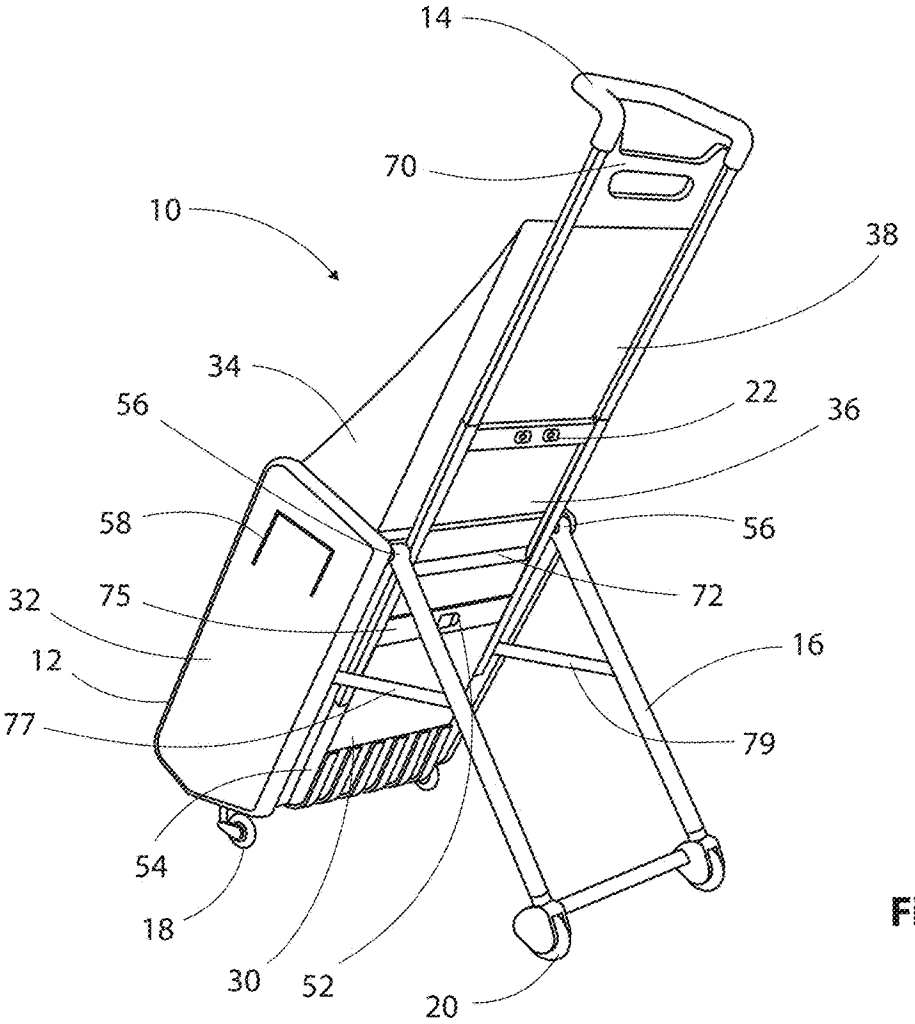
FIG. 3 shows a perspective view of the luggage apparatus of FIG. 1 in a stabilised configuration in which the luggage apparatus defines a seat for an infant.

The handle 14 can be further elevated to the position shown in FIG. 3 which facilitates pushing of the luggage apparatus 10. This configuration is called the stabilised configuration because elevation of the handle 14 to the stabilised configuration deploys the stabilising mechanism 16. The provision of stabilising mechanism 16 moves the centre of gravity of the luggage apparatus 10 to a more stable position.

To elevate the handle 14 to the highest position and to stabilise the luggage apparatus 10, the user firstly releases a clip 52 which permits relative movement of the handle support 75 with respect to the body portion 12.

The handle 14 can then be raised to the highest position, the handle 14 and handle support 75 moving together.

The stabilising mechanism 16 is stored in a recess 54 defined by the body portion 12 and is connected to the handle support 75 by a pair of hinged bars 77, 79. As the handle support 75 moves up the body portion 12 with the handle 14, the hinged bars 77, 79, deploy the stabilising mechanism 16 by pivoting stabilising mechanism 16 about a pair of spring loaded hinges 56.

It will be noted that the body portion wheels 18 are swivel mounted to the body portion 12 which assists when pushing the luggage apparatus 10 in the stabilised configuration. However in the other configurations, particularly the interim configuration where the apparatus is to be dragged, swivelling wheels are not necessary and may actually be a hindrance. For this reason, in the compact and interim positions the body portion wheels 18 are prevented from swivelling by the stabilising portion wheels 20.

Figure 4:
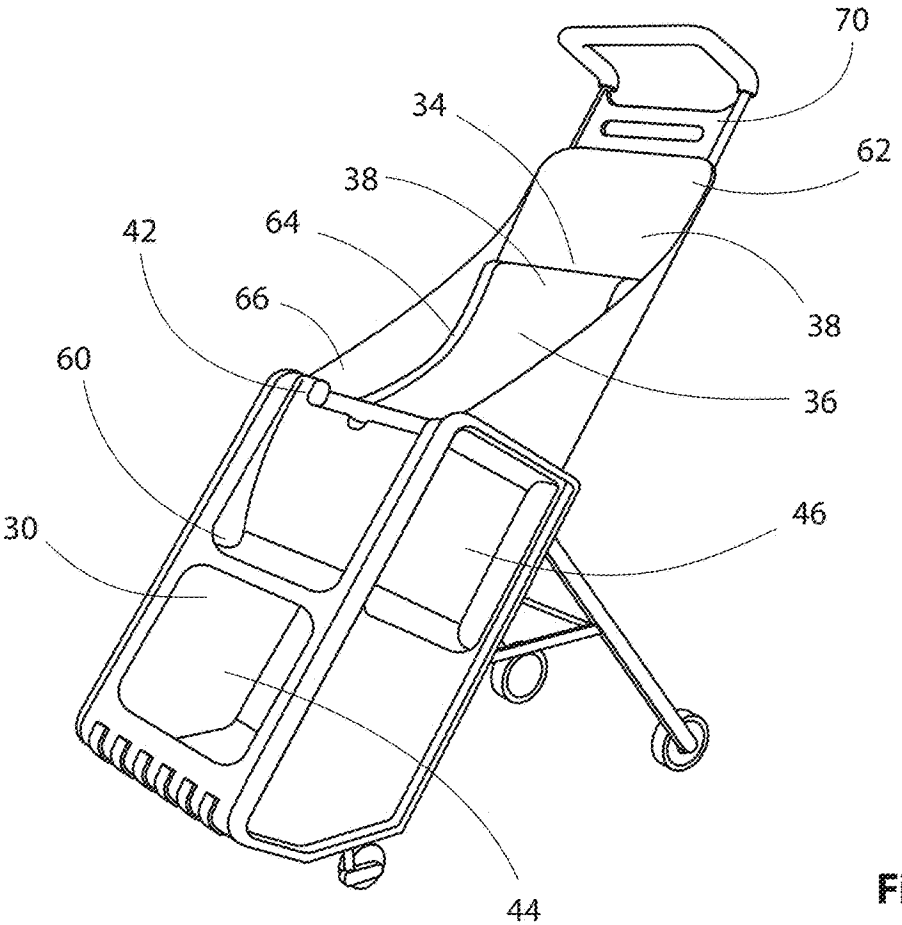
FIG. 4 shows a different perspective view of part of the luggage apparatus of FIG. 1 in a stabilised configuration.

FIG. 3 shows a side panel 32 with an access zip 58, the zip 58 is to access an interior of luggage apparatus 10, which can be seen on FIG. 4, a further perspective view of the luggage apparatus 10 of FIG. 1 in the stabilised configuration. As can be seen from FIG. 3 and FIG. 4, the body portion 12 comprises a frame 30, the frame 30 being covered with a series of removable coverings 34 of which the side panel 32 is one.

The frame 30 is moulded entirely out of expanded polypropylene and defines storage compartments 44,46 and part of a child's seat 34. Particularly the frame defines a footrest 60 and the child's bottom support 42.

The rest of the child seat, that is the backrest 62 and the associated safety features, can be formed once the luggage apparatus 10 is in the stabilised configuration. A plate 70, stored in a slot 72 (FIG. 3) is pulled up to form a backrest 62. An upper surface covering 36 and part of the front surface covering 38 can be unclipped from the frame 30 and plate 70 to reveal the bottom support 42 and to provide padding for the backrest. Attached to the coverings 36, 38 are straps 64 and side webs 66 to assist in securing the child within the seat 34.

Various modifications and improvements may be made to the above-described embodiment without departing from the scope of the invention. For example, the coverings 36, 38 could be stiff and form a back support in their own right.

The invention claimed is:

1. A luggage apparatus, the luggage apparatus comprising:

a body portion, the body portion comprising a frame and a base, wherein the frame covered with a surface covering, wherein the base comprising a plurality of corners, wherein the body portion further comprises a pair of wheels, each wheel associated with a corner of the base of the body portion;

a stabilising mechanism, the stabilising mechanism being movable with respect to the body portion from a stowed position to a deployed position, wherein the stabilising mechanism is pivotally attached to the body portion such that in moving from the stowed position to the deployed position the stabilising mechanism pivots with respect to the body portion, wherein the stabilising mechanism further comprises at least one wheel; and a handle, wherein the handle comprising a gripping portion and a connecting portion, the connecting portion connecting the gripping portion to the body portion, the connecting portion telescopically attached to the body portion and able to telescopically extend between a retracted position, a first extended position, and a second extended position;

wherein the luggage apparatus is convertible from a compact configuration to an interim configuration, and from the interim configuration to a stabilised configuration;

wherein in the compact configuration, the handle connecting portion is in its retracted position and the stabilising mechanism is in its stowed position;

wherein in the interim configuration, the handle connecting portion is in its first extended position and the stabilising mechanism is in its stowed position;

wherein in the stabilised configuration the luggage apparatus is configured for conversion to form a seat comprising a bottom support and a back support, wherein the handle connecting portion is moved to its second extended position, wherein a plate stored in a slot defined in the frame is pulled up to the gripping portion to form the back support, wherein the surface covering is unclipped from the frame to expose a seat bottom support defined by the frame in a top side of the frame; wherein the unclipped surface covering is attached to the handle connecting portion to provide padding for the back support, and wherein attached to the surface covering are straps and side webs to assist in securing a child within the seat; and wherein in the stabilised configuration, the stabilising mechanism can be moved to the deployed position, wherein in the deployed position, the body portion can be tilted from an upright position to an inclined position, in the inclined position the stabilising mechanism at least partially supporting the body portion.

2. The luggage apparatus of claim 1, wherein in the compact configuration, the bottom support and the back support are concealed within the body portion.

3. The luggage apparatus of claim 1, wherein a stabilising mechanism storage portion comprising a recess defined in the body portion for receiving the stabilising mechanism when in its stowed position.

4. The luggage apparatus of claim 1, wherein the frame further defines a footrest.

5. The luggage apparatus of claim 1, wherein the handle is linked to the stabilising mechanism such that moving the handle from the first extended position to the second extended position moves the stabilising mechanism to the deployed position.

6. The luggage apparatus of claim 1, wherein the surface covering comprises a front surface covering and an upper surface covering.

7. A luggage apparatus, the luggage apparatus comprising:

a body portion, the body portion comprising a frame and a base, wherein the frame covered with an upper surface covering and a front surface covering, wherein the base comprising a plurality of corners, wherein the body portion further comprises a pair of wheels, each wheel associated with a corner of base of the body portion;

a stabilising mechanism; the stabilising mechanism being movable with respect to the body portion from a stowed position to a deployed position, wherein the stabilising mechanism is pivotally attached to the body portion such that in moving from the stowed position to the deployed position the stabilising mechanism pivots with respect to the body portion, wherein the stabilising mechanism further comprises at least one wheel; and a handle, wherein the handle comprising a gripping portion and a connecting portion, the connecting portion connecting the gripping portion to the body portion, the connecting portion telescopically attached to the body portion and able to telescopically extend between a retracted position, a first extended position, and a second extended position, wherein the handle is linked to the stabilising mechanism such that moving the handle from the first extended position to the second extended position moves the stabilising mechanism to the deployed position;

wherein the luggage apparatus is convertible from a compact configuration to an interim configuration, and from the interim configuration to a stabilised configuration;

wherein in the compact configuration, the handle connecting portion is in its retracted position, the stabilising mechanism is in its stowed position, and the bottom support and the back support are concealed within the body portion;

wherein in the interim configuration, the handle connecting portion is in its first extended position and the stabilising mechanism is in its stowed position;

wherein in the stabilised configuration the luggage apparatus is configured for conversion to form a seat comprising a bottom support and a back support, wherein the handle connecting portion is moved to its second extended position, wherein a plate stored in a slot defined in the frame is pulled up to the gripping portion to form the back support, wherein the front surface covering and the upper surface covering are unclipped from the frame to expose a seat bottom support defined by the frame in a top side of the frame, wherein the unclipped front surface covering and the unclipped upper surface covering are attached to the handle connecting portion to provide padding for the back support, and wherein attached to at least one of the front surface covering and/or the upper surface covering are straps and side webs to assist in securing a child within the seat; and wherein in the stabilised configuration, the stabilising mechanism can be moved to the deployed position, wherein in the deployed position, the body portion can be tilted from an upright position to an inclined position, in the inclined position the stabilising mechanism at least partially supporting the body portion.

8. The luggage apparatus of claim 7, wherein in the compact configuration, the bottom support and the back support is concealed within the body portion.

9. The luggage apparatus of claim 7, wherein a stabilising mechanism storage portion comprising a recess defined in the body portion for receiving the stabilising mechanism when in its stowed position.

10. The luggage apparatus of claim 7, wherein the frame further defines a footrest.

* * * * *